US007472492B1

(12) United States Patent
Vecchio

(10) Patent No.: US 7,472,492 B1
(45) Date of Patent: Jan. 6, 2009

(54) STENCIL ASSEMBLY FOR MARKING PAVEMENT GRADE LEVELS

(76) Inventor: Charles J. Vecchio, 1728 Stewart Ave., Bellmore, NY (US) 11710

( * ) Notice: Subject to any disclaimer, the term of this patent is extended or adjusted under 35 U.S.C. 154(b) by 0 days.

(21) Appl. No.: 11/893,767

(22) Filed: Aug. 17, 2007

(51) Int. Cl.
*G01C 5/00* (2006.01)
*B28B 19/00* (2006.01)

(52) U.S. Cl. ..... 33/562; 33/1 H; 33/521; 33/566

(58) Field of Classification Search ..... 33/566, 33/1 G, 1 H, 521, 562, 666, 836, 833
See application file for complete search history.

(56) References Cited

U.S. PATENT DOCUMENTS

| | | | | | |
|---|---|---|---|---|---|
| 750,449 | A * | 1/1904 | Gillard | 33/836 |
| 944,462 | A * | 12/1909 | Osborne, Jr. | 33/521 |
| 968,996 | A | 8/1910 | Stackhouse | |
| 1,320,352 | A * | 10/1919 | Werner | 33/295 |
| 1,660,369 | A * | 2/1928 | Basich | 33/521 |
| 2,076,659 | A * | 4/1937 | Masson | 33/341 |
| 2,083,841 | A * | 6/1937 | Hall | 33/521 |
| 2,389,842 | A * | 11/1945 | Cummins | 33/833 |
| 2,650,435 | A * | 9/1953 | Kidd | 33/836 |
| 3,392,582 | A | 7/1968 | Pick et al. | |
| 4,837,940 | A | 6/1989 | Mahon | |
| 4,916,823 | A | 4/1990 | Kunze | |
| 5,068,970 | A | 12/1991 | Kunze | |
| 5,450,678 | A * | 9/1995 | Check | 33/833 |
| 5,775,036 | A * | 7/1998 | Stanley, Sr. | 52/127.2 |
| 6,298,574 | B1 | 10/2001 | Baker | |
| 6,412,185 | B1 * | 7/2002 | Mills et al. | 33/526 |
| 6,421,926 | B1 | 7/2002 | Cappuccio | |
| 6,698,348 | B1 * | 3/2004 | Bloss | 101/127 |

* cited by examiner

*Primary Examiner*—Christopher W Fulton
(74) *Attorney, Agent, or Firm*—George J. Brandt, Jr.

(57) ABSTRACT

A stencil assembly for marking paving required grade levels in a paving operation includes a front plate, a back plate and a support member, the support member being used to support the front and back plates on top of a curb. The front plate and the back respectively, carry finish grade level indicia, and sub par grade level indicia. The front and back plates can be relatively positioned one with respect to the other to present positioning of indicia at the levels where finish grade and sub par grade are to be located. The levels are marked on a side face of the curb so that sub par layer of, e.g., crushed stone can be applied up to the sub par grade level marking followed by applying the finish layer of, e.g., bituminous paving material up to the finish grade level, curb reveal at the outside face of the curb being a remaining distance between the finish grade level and the top of the curb.

14 Claims, 4 Drawing Sheets

STENCIL ASSEMBLY FOR MARKING PAVEMENT GRADE LEVELS

BACKGROUND OF THE INVENTION

The present invention relates to a stencil assembly for marking grade levels at work sites where roadway, runway, parking area and analogous surface paving operations are being carried out. It is also applicable for effecting markings in walkway, driveway and tennis court paving jobs.

In paving operations, various manners of indicating with markings, finish grade levels of paving material; such as asphalt or other material, as well as a level of a sub grade material such as crushed stone are known. Devices for use in defining or marking levels so as to guide work crews putting down layers of the materials also are known. A disadvantage of many prior art methods or devices used for making markings is the need to employ more than one worker for marking. These methods can involve use of marking rods and stakes and erection of string lines or other guide courses. Where known marking practices can be employed with but one worker, the marking task is more time consuming than need be.

It is desirable, therefore, that a marking device such as a stencil which allows for rapid, sure and simplified device use be provided, thereby overcoming the drawbacks of the prior art.

SUMMARY OF THE INVENTION

An object of the invention is to provide a marking stencil that is of simplified yet most effective construction while at the same time simple to use.

Another object is to provide a marking stencil that provides for reduction of the time it takes to effect site marking as compared to time involved when using prior art devices.

A further object is to provide a marking stencil that requires but one worker to effect marking.

A still further object is to provide a marking stencil that enables making of both finish grade and sub grade marking is a single marking application step.

A still further object is to provide a marking stencil which is inexpensively fabricated.

Another object is to provide a marking stencil that has a long service life.

Another object is to provide an improved, rapidly and surely practiced manner of depth marking a paving course.

In accordance with the invention, a stencil assembly for marking paving required grade levels in a paving operation includes a front plate, a back plate, and a support member. Upper and lower arranged pairs of fasteners are provided for captively fastening the front plate, back plate and support member in assembled relationship. The front plate, back plate and support member are provided with blind slots at each marginal side of such components, the location of the slots in each component being such that there is registry of the slots allowing reception and pass through of the fasteners.

The arrangement of a captive fastening means allows for adjustably relatively positioning the front plate with respect to the back plate and for selectively positioning the support member on the back plate. A finish grade level indicia is carried on a lower part of the front plate, and a sub par grade indicia is carried on a lower part of the back plate. The front plate carries vertically uniformly spaced numeric indicator lines, numeric values associated with these lines increasing from a lowest value at the topmost line to a highest value at the lowermost line, these numerics being arranged in a vertical column proximal a margin of the front plate and being associated with a finish grade layer thickness. The back plate also carries graduation indicator lines arrayed at each of the two marginal side areas of the back plate. A selected one indicator line in at least one back plate indicator line array is highlighted to provide it with readily discernible appearance differentiating it from others of the indicators lines in the array. This selected one indicator line is the uppermost indicator line in the array and is a locator at which an indicator line on the front plate and associated with a selected finish grade layer thickness is positioned when setting the stencil for marking the selected finish grade level.

In using the stencil, a workman will loosen the stencil assembly to position the front plate on the back plate so that a front plate indicator line having the numeric value corresponding to the paving finish layer thickness, in inches, overlays the highlighted indicator line locator on the back plate. By way of example, a front plate indicator line associated with numeral "2" in the marginal vertical numeral column will overlay the highlighted indicator line locator of the back plate when a two inch finish grade layer is to be put down on top of a, e.g., stone sub grade. The front plate is then affixed to the back plate with the lower fastener pair. The workman will then adjust a position of the support member at the rear face of the back plate to set the support member on the assembly in correspondence to what the curbside reveal value above the finish layer is to be. By way of example and if the reveal is to be 6 inches, the workman will position the support member so that a lower surface thereof is aligned with a front plate graduation associated with the numeral "6" contained in another front plate column of numbers, this column being centered on the front plate. The support member is then affixed to the back plate with the upper fastener pair.

With the front and rear plate and the support member locked together, the stencil can then be placed on a top face of a curb, the plates depending down alongside an outside face of the curb. With the stencil thus located, the finish grade indicia on the front plate, and the sub par grade indicia on the back plate are vertically spaced, for example, 2 inches—this representing a selected one of thickness of the finish layer to be laid down. The finish grade and sub par grade indicia are formed in the associated plate as through openings in the respective plates. The openings can be fashioned as distinctive shapes, one clearly different in look than the other. The workman now applies a marking such as a paint spray through each indicia opening. The workman now lifts the stencil and moves along the paving line to a succeeding location where the marking procedure is repeated until the full paving course is marked. The paving operation can proceed along with and behind the marking operation since the marking operation is effectively and efficiently carried out without any lag or delay.

The column of graduation lines proximal a margin of the front plate are given in half inch and inch units while those in the centered column of numerals are in inch units. The indicator lines and markings on the plates can be defined by painted line, groove or slot formation or any other suitable manner of visible depiction. The lines and markings can be applied directly to a front face or back face of the plates, the indicator lines and markings being clearly defined by making the front and back plates of a transparent material, e.g., a synthetic material such as LEXAN.

The above, and other objects, features and advantages of the invention will become apparent from the following description read in conjunction with the accompanying drawings, in which like reference numerals designate the same elements.

DESCRIPTION OF THE PREFERRED EMBODIMENTS

Figure 1:
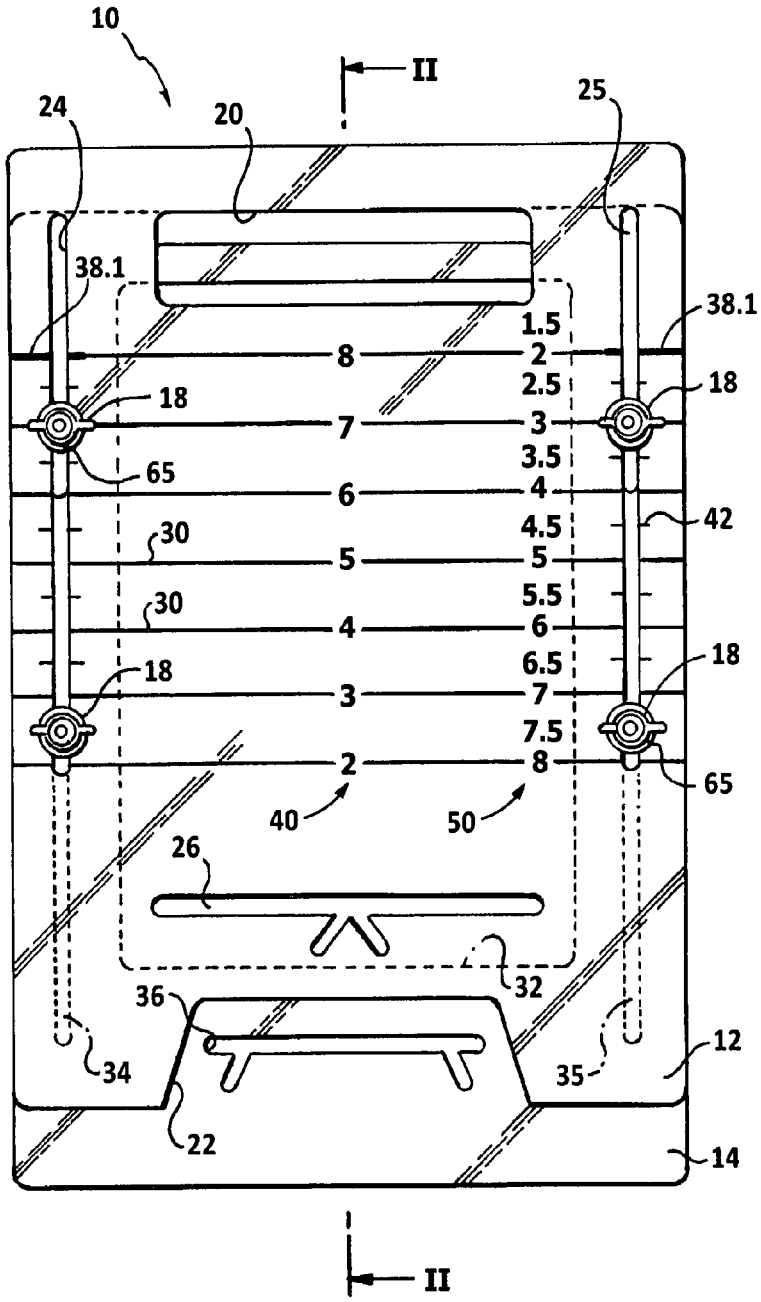
FIG. 1 is a front elevation view of the stencil assembly for marking pavement grade levels made in accordance with the invention.
Figure 2:
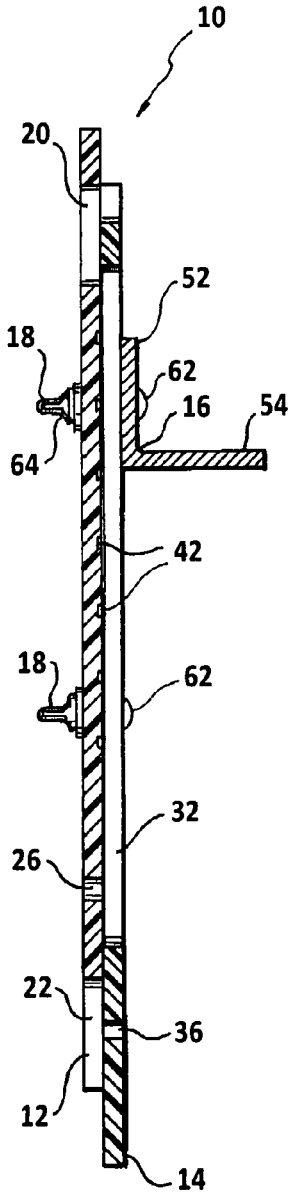
FIG. 2 is a sectional view of the assembly taken along the line II-II in FIG. 1.

Referring to FIGS. 1 and 2, the stencil assembly 10 includes as assembled together components, a front plate 12, a back plate 14, and a support member 16. Plates 12 and 14 preferably are made from a transparent material such as a LEXAN type material. The plates 12, 14 and support member 16 are affixed or connected together with means such as upper and lower sets of fasteners 18.

Figure 3:
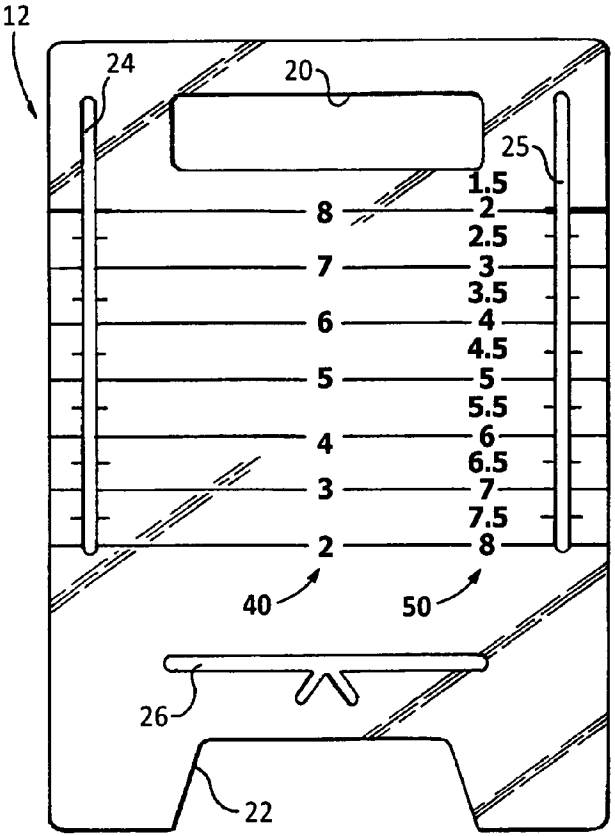
FIG. 3 is a front elevation view, on reduced scale, of the assembly front plate.

Referring to FIG. 3, the front plate 12 is a flat member measuring approximately 15 inches length by approximately 10 inches width. An elongated opening 20 in a top area of the front plate is provided so as to define a stencil hand hold handle part to facilitate carrying and using the stencil. A recessed window slot 22 is provided in a bottom area of plate 12 for purpose as will be described later. Plate 12 is provided with elongated blind end slots 24, 25 disposed proximal each longitudinal margin of the plate. A finish grade level indicia 26 is formed in plate 12 being located a short distance above recessed window slot 22. Most conveniently, the indicia 26 is fashioned as a through opening passing from front face to rear face in the plate 12.

Front plate 12 also is provided with a transversely directed, vertically spaced array of indicator lines 30, the lines 30 passing from left to right the full width of the plate. The indicator lines 30 can embodied on the plate 12 in various ways such as being painted on the front face of the plate. A preferable manner of affixing the graduation lines is to fashion them as grooves in the rear face of the front plate. A top margin of finish grade level indicia 26 is located a fixed distance of 2 inches below the lowermost indicator line 30. The indicator lines 30 are further identified with numeral indicia 40 (FIG. 1) which represent the measurement distance in inches of the indicator lines 30 above the top of grade level indicia 26, this column of numeral indicia 40 being centered on the front face of plate 12. The indicator lines 30 and numerals indicia 40 represent values of reveal distances at a curb outside face as will be described in more detail later. Front plate 12 also carries a column of numeral indicia 50 disposed adjacent the right side plate margin, this numeral indicia being characterized by presenting a half inch spacing measure. The indicia 50 are associated with the indicator lines 30 extending the full width of the front plate spaced one inch apart, and with indicator lines 42 carried at the marginal areas of the front plate. The indicator lines 42 are each disposed a half inch from indicator lines 30 above and below said each indicator line 42. This numeral indicia represents a measure in half inch increments of the selected thickness of a finish grade layer to be laid down in the paving operation for which marking with the stencil is required. The numerals 50 in this column start with the smallest finish grade layer thickness at the top of the front plate and increase toward the bottom of the column.

Figure 4:
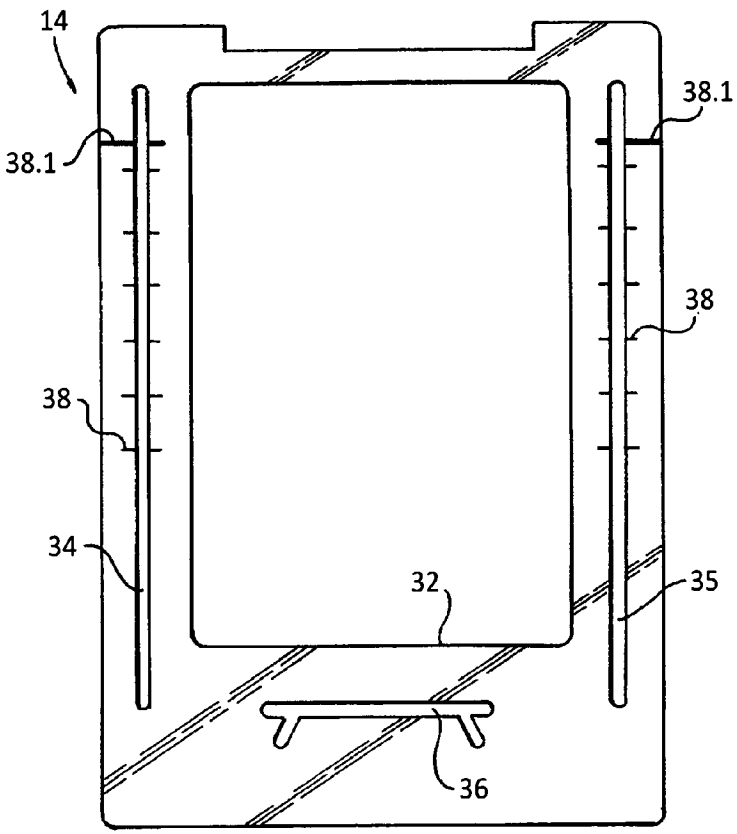
FIG. 4 is a front elevation view, on reduced scale, of the assembly back plate.

Referring to FIG. 4, back plate 14 has a large central opening 32, elongated blind slots 34, 35 disposed proximal the plate side margins, and a sub par grade level indicia 36, this indicia 36 being like finish grade level indicia 26, an opening passing through the back plate from front to rear face thereof. Slots 34, 35 of back plate 14 are longer in length than the slots 24, 25 in front plate 12. Sub par grade level indicia 36 is configured in shape different than that of indicia 26 to readily differentiate the respective two purposes of these indicia. In use relative positioning of the front and back plates can be such that indicia 36 will be either framed within recessed window slot 22 of front plate 12, or located below that window slot. Generally, the indicia 36 will be framed within the window slot 22 whenever the stencil is being employed where a finish grade layer thickness is one in a range up to about three inches. When finish grade layer thickness is three and one-half inches or more, sub par grade level indicia 36 will be spaced below the finish grade level indicia 26 a distance that uncovers a bottom portion of the large central opening 32 in back plate 14.

With the opening 32 uncovered, it is easy for a spraying agent being applied through the openings of indicia 26 and 36 to also be applied on unintended areas of a curb outside face. This is undesirable as mismarking on the curb outside face could merge with the paint sprayed through the indicia 26 and 36 onto the curb outside face. To prevent the mismarking, tape can be applied over the curb outside face where the uncovered area of opening 32 juxtaposes with the curb outside face. In this way, the tape covered with spray paint can be removed leaving the painted depictions of indicia 26 and 36 of the curb outside face sharp and clear to guide the workman spreading the sub par grade material and the finish grade material layers.

Back plate 14 is provided with indicator lines 38, preferably as slots in the rear face of the plate, spacing of these indicator lines 38 being a half inch between.

Figure 5:
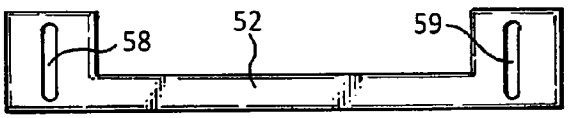
FIG. 5 is a front elevation view, on reduced scale of the support member.

Referring to FIG. 5, support member 16 is an elongated angle piece having flanges 52, 54, the flanges having relieved or recessed lengths as at 56. Flange 52 which is normally the part assembled to the back plate is provided with blind slots 58, 59. Flange 54 is the support member part that engages a curb or like top surface for supporting the stencil in marking position during marking use. The blind slots in the front and back plate and in the support member flange 52 are arranged such that they are all in registry when the stencil is assembled, and it is through these registering blind slots that the fasteners pass.

As seen best from FIGS. 1 an 2, plates 12, 14 and support member 16 are captively connected together with fasteners 18 that include bolts 62 inserted through the rear of the assembly by way of components slots 24, 25, 34, 35, 58 and 59 to the assembly front. At the front, wing nuts 64 are received on the bolts for tightening the plates 12, 14 and support member 16 together in a use configuration. Washers 65 also are used intermediate the face of front plate 12 and the wing nuts 64. The fasteners are loosened to allow relative position changes between plates 12 and 14 and support member 16 to change the distances between indicia 26 and 36 when markings are to be made where finish grade layer thickness and sub par grade specifications as well as a reveal depth are altered from one to others of settings of the assembly components.

Figure 6:
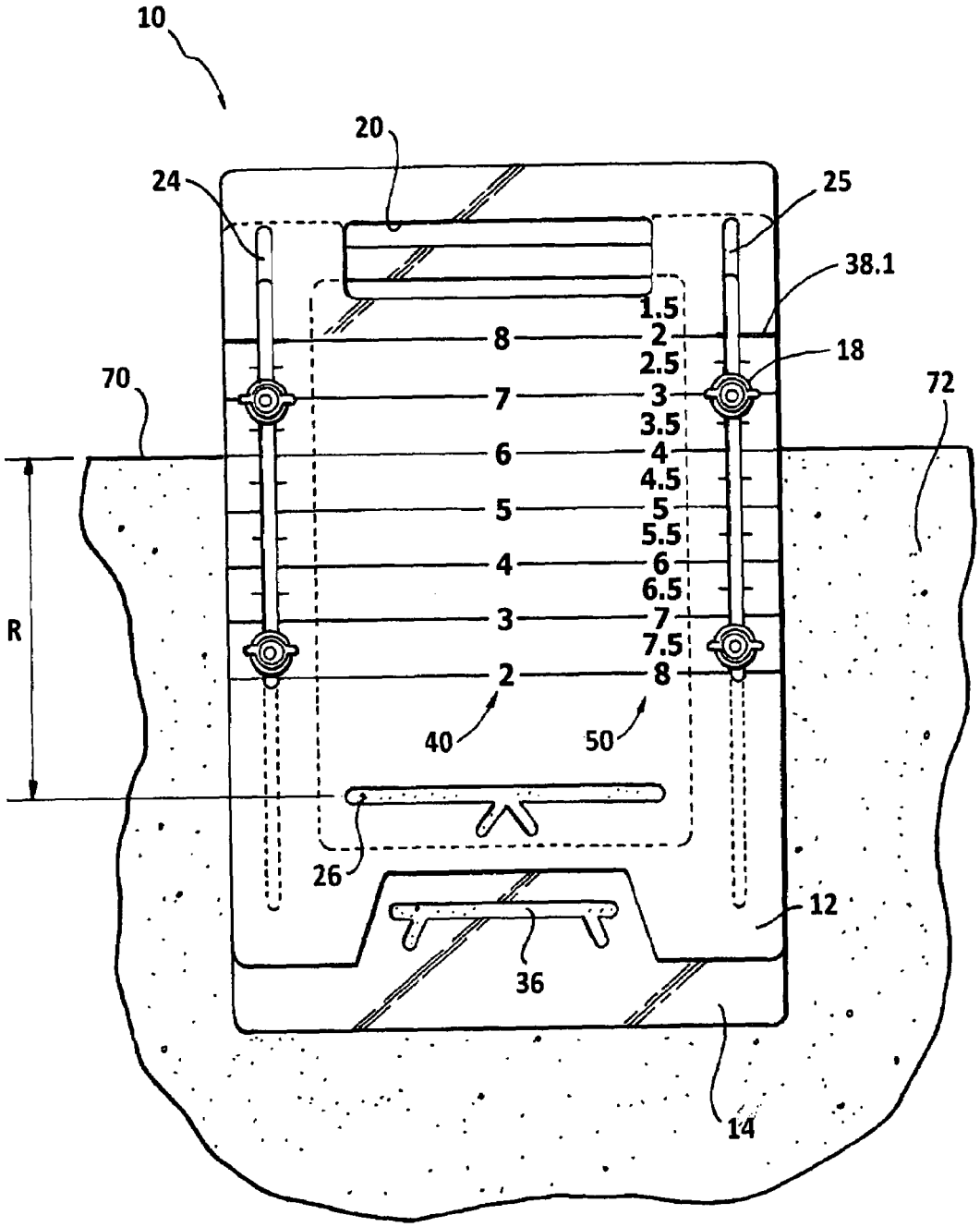
FIG. 6 is a front elevation view on reduced scale of the stencil assembly mounted in a use position thereof wherein it is mounted on the top surface of a curb installed at a site where a pavement or roadway is being built.
Figure 7:
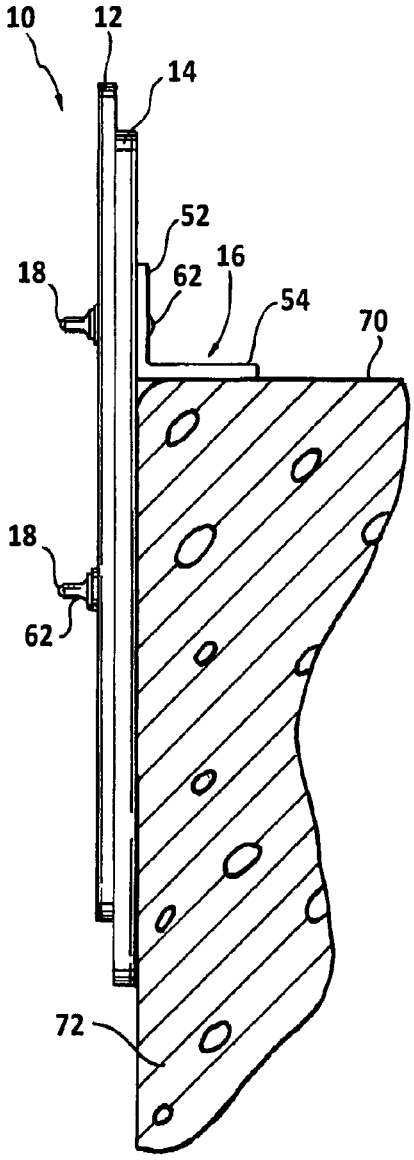
FIG. 7 is a side elevation view of the FIG. 6 depicted stencil mounting.
Figure 8:
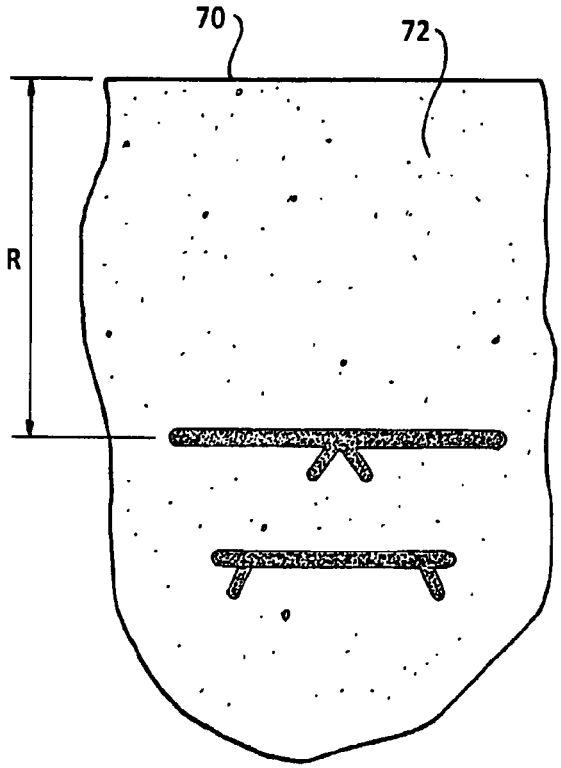
FIG. 8 is a front view of a curb face on which has been stenciled with the stencil of the invention and using a paint spray, the finish grade level and the sub par grade level markings required as a preliminary to laying down a road way, pavement etc.

Description is now given of a representative marking setup and use of the stencil assembly and with additional reference to FIGS. 6-8. It will be understood that finish grade layer thicknesses and reveal values can be varied over a range of such. In the below described example, the finish grade thickness is two inches and a reveal on the curb outside face is six inches. Depending on a particular job specification, the finish grade layer thickness could be three inches and the reveal five inches or other combinations of such values.

A workman will first loosen the fasteners 18 in both pairs of same so that the front plate 12, back plate 14 and support 16 are moveable one relative to another. The front plate 12 and the back plate 14 will be manipulated as by sliding of one on the other, and until a front plate indicator line 50 associated with numeral "2" in the front plate marginal numeral column overlays the finish grade level locator marking 38-1 of the back plate. Locator marking 38-1 can be highlighted with, e.g., red paint. With proper over laying of the "2" graduation line with the locator marking 38-1 having been effected, the workman then tightens the lower pair of fasteners 18 to affix the front plate 12 to the back plate 14 in a relative positioning of these two plates wherein a top of the finish grade level indicia 26 of the front plate 12 is spaced "2" above a top of the sub par grade level indicia 36. While the lower pair of fasteners 18 are tightened, the upper pair fasteners 18 are still loose.

The workman will now slide the support member 16 along the rear face of back plate 14 until the bottom face of flange 54 is coincident with the indicator line associated with numeral "6" in the center numeral column on the front plate front face—this because the reveal is to be "6". The workman will then tighten the upper pair of fasteners. The stencil is now set so that when it is suspended from a curb top face 70 at the paving site extending down alongside the curb outside face 72, the top of the finish grade level indicia 26 locates 6 inches below the curb top face 70 and the reveal R above the paving finish layer will be 6 inches.

The workman now applies a paint spray coating to the curb outside face 72, the paint passing through the open expanses of indicia 26 and 36. The paint is quick drying and when the stencil is picked up for further use down the paving line, the painted on finish grade indicia 26 marking and sub par grade indicia 36 marking remain on the curb inside face as shown in FIG. 8 to guide the workman following in putting down the sub par grade fill material and the finish grade material.

It is to be understood that the stencil can be used for marking where finish grade level thicknesses and reveal heights can vary over a range of each. In any given case, the reference numeral 50 on front plate 12 corresponding to the finish grade thickness involved will be registered with the finish grade locator 38-1 on the back plate 14. Similarly, the reveal in each case will be set by aligning the bottom surface of the support member 16 in coincidence with the indicator line 30 on front plate 12 which corresponds to the reveal value involved.

Having described preferred embodiments of the invention with reference to the accompanying drawings, it is to be understood that the invention is not limited to these precise embodiments, and that various changes and modifications may be effected therein by one skilled in the art without departing from the scope or spirit of the invention as defined in the appended claims.

What is claimed is:

1. A stencil assembly for marking paving required grade levels in a paving operation, comprising:

a front plate, said front plate carrying a first array of indicator lines arrayed transversely across a face of said front plate, said indicator lines being uniformly spaced apart one from another, said front plate further carrying a column of numeric measurement numerals centrally located on said front plate, each of said numerals being associated with a curb outside face reveal dimension measurement visable above a paving finish grade level, said front plate carrying a second array of indicator lines disposed on at least one side marginal area of said front plate, each second array indicator line being disposed intermediate succeeding pairs of first array indicator line lengths at said one marginal area of said front plate, said front plate carrying an additional column of numerals at said front plate one side marginal area, said additional column numerals each being associated with at least one of said first array indicator line lengths and said second array indicator lines, said additional column numerals each representing a finish grade thickness;

a support member, said support member having a curb engagable flange receivable on a top face of a curb for mounting the stencil assembly in a use position thereof on said curb;

a finish grade level indicia carried on said front plate, said finish grade level indicia being located on said front plate a fixed distance below a lowermost indicator line in said first indicator line array, an uppermost indicator line in said first indicator line array being located proximal a top end of said front plate, the numerals in said centrally located column increasing from a least value of said lowermost indicator line to a highest value of said uppermost indicator line;

a sub par grade level indicia carried on a back plate proximal a bottom end of said back plate, said back plate having a finish grade level locator marking line disposed on a marginal side area part of said back plate and located proximal a top end of said back plate; said finish grade level indicia and said sub par grade level indicia each comprising openings in said front plate and said back plate, respectively, through which a marking agent can be applied to a curb surface; and means for captively fastening said front plate, said back plate and said support member together with said back plate disposed between said front plate and said support member, a relative positioning between the front and back plates being set to register an indicator line associated with a selected finish grade thickness with said finish grade level locator marking line on said back plate, the front plate then being locked to the back plate with said fastening means, the support member then being adjusted on the back plate to locate said curb engagable flange registered with the first array indicator line corresponding to a column numeral associated with a selected reveal measurement.

2. A stencil assembly in accordance with claim 1, in which said finish grade level indicia and said sub par grade level indicia are configured in shape different one from a other to differentiate the purpose of each said indicia.

3. A stencil assembly in accordance with claim 1, in which said back plate carries a third array of indicator lines disposed at a side marginal area of said back plate and extending from top to bottom of said back plate, said finish grade level locator marking line comprising an uppermost one of said third array indicator lines.

4. A stencil assembly in accordance with claim 3, in which said uppermost third array indicator line is highlighted in appearance to differentiate it from others of said third array indicator lines.

5. A stencil assembly in accordance with claim 4, in which said uppermost third array indicator line is highlighted by having a coloration different from a coloration of said others of said third array indicator lines.

6. A stencil assembly in accordance with claim 3, in which said front and back plates are transparent material members.

7. A stencil assembly in accordance with claim 6, in the indicator lines in each of said first, second and third arrays of indicator lines comprise one of grooves and painted lines.

8. A stencil assembly in accordance with claim 7, in which said grooves are disposed at a rear face of said front plate.

9. A stencil assembly in accordance with claim 1, in which said captively fastening means includes elongated slots in each of said front plate and said back plate proximal each lateral margin of said plates, the slots of each plate having registering runs with the slots of a other plate, and selectively tightened selectively loosened fasteners, a first pair of fasteners extending through the slots of said plates for securing said front plate and said back plate together, a second pair of fasteners extending through slots in a second flange of said support member and the slots of said back plate to secure said support member to said back plate.

10. A stencil assembly in accordance with claim 9, in which all of said slots are blind slots.

11. A stencil assembly in accordance with claim 9, in which the slots of said back plate are longer than the slots of said front plate.

12. A stencil assembly in accordance with claim 9, wherein said fasteners comprise bolts and nuts.

13. A stencil assembly in accordance with claim 1, in which an upper part of said front plate has an opening therein defining an assembly carrying handle.

14. A method for marking pavement grade levels comprising:

providing a stencil having a front plate carrying a finish grade level indicia, a back plate carrying a sub par grade level indicia, said finish grade level indicia and said sub par grade level indicia each being defined by through openings formed in the front and back plates respectively, a support member, and fastener means for captively connecting the front and back plates together and for connecting the support member to the back plate, said front plate carrying an array of plural indicator lines on a center part of a front face thereof representing measurement distances of a curb reveal to be provided above a paving finish the grade level, there being numerals associated with said indicator line array distances, said front plate carrying a column of additional indicator lines disposed adjacent a front plate side margin, there being numeral indicia carried on the front face of said front plate alongside said further indicator lines and representing a thickness of a finish grade layer to be laid down in the paving operation, a side marginal area of a face of said back plate carrying a finish grade level highlighted locator marking line disposed thereon proximal a top end of said back plate;

adjusting the front plate relative to the back plate such as to register a selected one of said additional indicator lines representing said finish grade thickness in overlaying relationship with the finish grade level highlighted locator marking line on said back plate;

affixing said front plate to said back plate with said fastener means;

adjusting the support member against a rear face of said back plate to position a support member bottom face coincident with a front plate distance array graduation line corresponding to a reveal measurement to be left at a curb outside face following lay down of the finish grade;

affixing the support member to the back plate;

suspending the stencil from a curb by disposing said support member bottom face on top of a curb top face and with the front and back plates extending down alongside an outside face of the curb; and applying a coating of a marking medium through said finish grade level indicia and sub par grade level indicia defined openings onto said outside curb face.

* * * * *